US011964805B2

(12) United States Patent
Kim et al.

(10) Patent No.: US 11,964,805 B2
(45) Date of Patent: Apr. 23, 2024

(54) CONTAINER FOR RETORT FOOD

(71) Applicant: CJ CHEILJEDANG CORPORATION, Seoul (KR)

(72) Inventors: Ki Pyo Kim, Seoul (KR); Yong Hwan Kim, Seoul (KR); Kyoung Sik Cho, Seoul (KR); Kwang Soo Park, Gwacheon-si (KR); Byung Kook Lee, Seoul (KR)

(73) Assignee: CJ CHEILJEDANG CORPORATION, Seoul (KR)

( * ) Notice: Subject to any disclaimer, the term of this patent is extended or adjusted under 35 U.S.C. 154(b) by 406 days.

(21) Appl. No.: 17/425,476

(22) PCT Filed: Jan. 23, 2020

(86) PCT No.: PCT/KR2020/001212
§ 371 (c)(1),
(2) Date: Jul. 23, 2021

(87) PCT Pub. No.: WO2020/153808
PCT Pub. Date: Jul. 30, 2020

(65) Prior Publication Data

US 2022/0097933 A1 Mar. 31, 2022

(30) Foreign Application Priority Data

Jan. 25, 2019 (KR) ..... 10-2019-0010066

(51) Int. Cl.
*B65D 51/24* (2006.01)
*B65D 77/20* (2006.01)
*B65D 81/32* (2006.01)

(52) U.S. Cl.
CPC ..... *B65D 51/247* (2013.01); *B65D 77/2008* (2013.01); *B65D 77/2024* (2013.01); *B65D 81/3216* (2013.01); *B65D 2251/0028* (2013.01)

(58) Field of Classification Search
CPC ..... B65D 51/247; B65D 77/2008; B65D 77/2024; B65D 2251/0028; B65D 81/3216
See application file for complete search history.

(56) References Cited

U.S. PATENT DOCUMENTS 3,576,113 A 4/1971 Swett et al.
3,954,178 A * 5/1976 Mason, Jr. ..... B65D 71/00 206/508

(Continued)

FOREIGN PATENT DOCUMENTS

CN 101298291 A 11/2008
CN 103565063 A 2/2014

(Continued)

OTHER PUBLICATIONS

English translation of EP 2,450,292 (Bader). (Year: 2023).*

(Continued)

*Primary Examiner* — James N Smalley
(74) *Attorney, Agent, or Firm* — CANTOR COLBURN LLP

(57) ABSTRACT

The present disclosure relates to a container for retort food and, more specifically, to a container for retort food including: a container body in which food may be input and stored; and an inner cap covering the container body. The inner cap covering the container body has a predetermined depth, and thus, effective sterilization may be performed during a retort processing process, overflow of the food in the container body may be prevented, and there is an advantage in satisfying regulations regarding a packing space ratio.

12 Claims, 9 Drawing Sheets

(56) References Cited

U.S. PATENT DOCUMENTS

| | | | | | |
|---|---|---|---|---|---|
| 4,997,691 | A * | 3/1991 | Parkinson | B29C 51/422 428/36.6 |
| 5,377,860 | A * | 1/1995 | Littlejohn | B65D 51/1611 220/784 |
| 2005/0051549 | A1 * | 3/2005 | Nelson | B65D 81/3216 220/23.83 |
| 2010/0307116 | A1 * | 12/2010 | Fisher | B65D 77/20 206/505 |
| 2015/0203223 | A1 | 7/2015 | Ehrmann | |

FOREIGN PATENT DOCUMENTS

| | | | | |
|---|---|---|---|---|
| CN | 203612414 | U | 5/2014 | |
| DE | 102017116602 | A1 * | 1/2019 | B65D 1/26 |
| EP | 2450292 | A1 * | 5/2012 | B65D 1/26 |
| GB | 1389000 | A | 4/1975 | |
| JP | H06345131 | * | 12/1992 | B65D 77/02 |
| JP | 05004658 | A | 1/1993 | |
| JP | 06345131 | A | 12/1994 | |
| JP | 10086978 | A | 4/1998 | |
| JP | 3004391 | B2 | 11/1999 | |
| JP | 2007076709 | A | 3/2007 | |
| JP | 2007176519 | A | 7/2007 | |
| JP | 2009067393 | A | 4/2009 | |
| JP | 2012081999 | A | 4/2012 | |
| JP | 2016216089 | A | 12/2016 | |
| KR | 200487577 | Y1 | 10/2018 | |
| KR | 102049388 | B1 | 11/2019 | |
| WO | WO-0104007 | A2 * | 1/2001 | B65D 25/08 |
| WO | WO-2015015241 | A1 * | 2/2015 | B65D 1/185 |

OTHER PUBLICATIONS

Chinese Office Action for Application No. 202080010404.2 dated Jul. 5, 2022.

Korean Office Action for Application No. 10-2019-0010066 dated Mar. 21, 2019.

International Search Report for Application No. PCT/KR2020/001212 dated Apr. 29, 2020.

Written Opinion for PCT/KR2020/001212 dated Apr. 29, 2020.

The Extended European Search Report for Application No. 20745665.8-1014 / 3915898 PCT/KR2020001212; Date of Completionof Search: Sep. 22, 2022; 7 pages.

* cited by examiner

CONTAINER FOR RETORT FOOD

TECHNICAL FIELD

The present disclosure relates to a container for retort food and, more specifically, to a container for retort food including: a container body in which food may be input and stored; and an inner cap covering the container body. The inner cap covering the container body has a predetermined depth, and thus, effective sterilization may be performed during a retort processing process, overflow of the food in the container body may be prevented, and there is an advantage in satisfying regulations regarding a packing space ratio.

BACKGROUND ART

When eating retort food having liquid-phase contents, the food may overflow to the outside due to an insufficient depth of a container during eating or carrying of the food. When increasing the depth of the container to prevent this overflow, a large gap may be formed between the food inside the container and a cap above the container, making it difficult to perform sterilization during a retort processing process and also making it difficult to satisfy regulations regarding a packing space ratio. For example, the Korean existing laws regulate a packing space ratio of a product such that the volume of an empty space to the volume of a packing space with respect to food and drink has to be 10 to 35% or less. Thus, when increasing the depth of the container and enlarging the empty space to prevent the overflow, it may be difficult to satisfy these regulations.

Also, when it comes to instant rice products, products capable of conveniently replacing meals, such as rice soup, rice with toppings, and bibimbap, have been sold. Such a product generally has the form of an integrated product in which contents are individually packed and put together. Thus, a consumer has to remove each of packing materials and mix so as to eat food, and there is an inconvenience in that the consumer has to dispose of waste packing materials. Also, since these packing materials are individually packed, large amounts of packing materials are discarded when eating the food, which causes limitations in terms of costs and environment.

Thus, it is necessary to develop a container for retort food, which may ensure sterilization efficiency in a retort process while sufficiently securing an overflow space, satisfy the regulations regarding the packing space ratio, and have the advantage of disposing of packing materials.

DESCRIPTION OF EMBODIMENTS

Technical Problem

Provided is a container for retort food including: a container body in which food may be input and stored; and an inner cap covering the container body. The inner cap covering the container body has a predetermined depth, and thus, effective sterilization may be performed during a retort processing process, overflow of the food in the container body may be prevented, and there is an advantage in satisfying regulations regarding a packing space ratio.

Solution to Problem

According to an aspect of the present disclosure, a container for retort food includes: a container body; and an inner cap, wherein the container body includes a container bowl part having a space which is recessed with a first depth in a downward direction and open in an upward direction and a container flange part constituting a periphery of an upper end of the container bowl part, wherein the inner cap includes a cap tray part having a space which is recessed with a second depth in the downward direction and open in the upward direction and a cap flange part constituting a periphery of an upper end of the cap tray part, wherein, when the inner cap is placed on the container body, the cap tray part is located inside an upper region of an inner space of the container bowl part of the container body, and the cap tray part divides the inner space of the container bowl part into upper and lower spaces, wherein, when thermal fusion is performed in a state in which the cap flange part is placed on the container flange part, the lower space inside the container bowl part is sealed.

According to an example, the container body is made of a first sheet having a predetermined thickness, and the inner cap is made of a second sheet having a predetermined thickness, and the first sheet is two times to four times as thick as the second sheet.

According to an example, the first sheet has a thickness of 0.9 mm to 1.2 mm, and the second sheet has a thickness of 0.3 mm to 0.4 mm.

According to an example, each of the container body and the inner cap has a multi-layer structure including an oxygen impermeable material.

According to an example, the inner cap includes an easy peelable (EPL) material so as to be easily peelable from the container flange part in a state in which a bottom surface of the cap flange part is thermally fused to a top surface of the container flange part.

According to an example, each of the container bowl part and the cap tray part has, in at least a portion thereof, an arrangement portion having a predetermined width in a circumferential direction and having curvature different from that of the other regions.

According to an example, the container body has a container handle that protrudes from the container flange part in an outer diameter direction, and the inner cap has a cap handle that protrudes from the cap flange part in an outer diameter direction, wherein a stepped portion is formed between the container handle and the container flange part, and a top surface of the container handle is located below a top surface of the container flange part.

According to an example, the container bowl part has a polygonal structure.

According to an example, the cap tray part has a three-dimensional rib structure on a bottom surface thereof.

According to an example, the three-dimensional rib structure includes: a first rib which is made of protrusions and recesses repeatedly formed along a circumferential region on the bottom surface of the cap tray part; and a second rib which is formed on the bottom surface of the cap tray part and has a ring shape having a predetermined inner diameter and of which a cross-section has a shape having predetermined curvature.

According to an example, the cap tray part has a plurality of stacking protrusion portions.

According to an example, three to six stacking protrusion portions are provided, and formed on the bottom surface of the cap tray part and has a three-dimensional structure that protrudes in the upward direction.

According to an example, there is provided a rib which is formed on the bottom surface of the cap tray part and has a ring shape having a predetermined inner diameter and of which a cross-section has a shape having predetermined curvature, wherein the stacking protrusion portions are formed at positions overlapping the rib.

According to an example, there is further provided a lid film which is located above the inner cap to cover an inner space of the cap tray part and is in close contact with a top surface of the cap flange part.

Advantageous Effects of Disclosure

In a container for retort food according to the present disclosure, effective sterilization may be performed during a retort processing process, overflow of the food in the container body may be prevented, and there is an advantage in satisfying regulations regarding a packing space ratio.

BEST MODE

According to an aspect of the present disclosure, a container for retort food includes: a container body; and an inner cap, wherein the container body includes a container bowl part having a space which is recessed with a first depth in a downward direction and open in an upward direction and a container flange part constituting a periphery of an upper end of the container bowl part, wherein the inner cap includes a cap tray part having a space which is recessed with a second depth in the downward direction and open in the upward direction and a cap flange part constituting a periphery of an upper end of the cap tray part, wherein, when the inner cap is placed on the container body, the cap tray part is located inside an upper region of an inner space of the container bowl part of the container body, and the cap tray part divides the inner space of the container bowl part into upper and lower spaces, wherein, when thermal fusion is performed in a state in which the cap flange part is placed on the container flange part, the lower space inside the container bowl part is sealed.

MODE OF DISCLOSURE

Hereinafter, preferred examples according to the present disclosure will be described with reference to the accompanying drawings.

Figure 1:
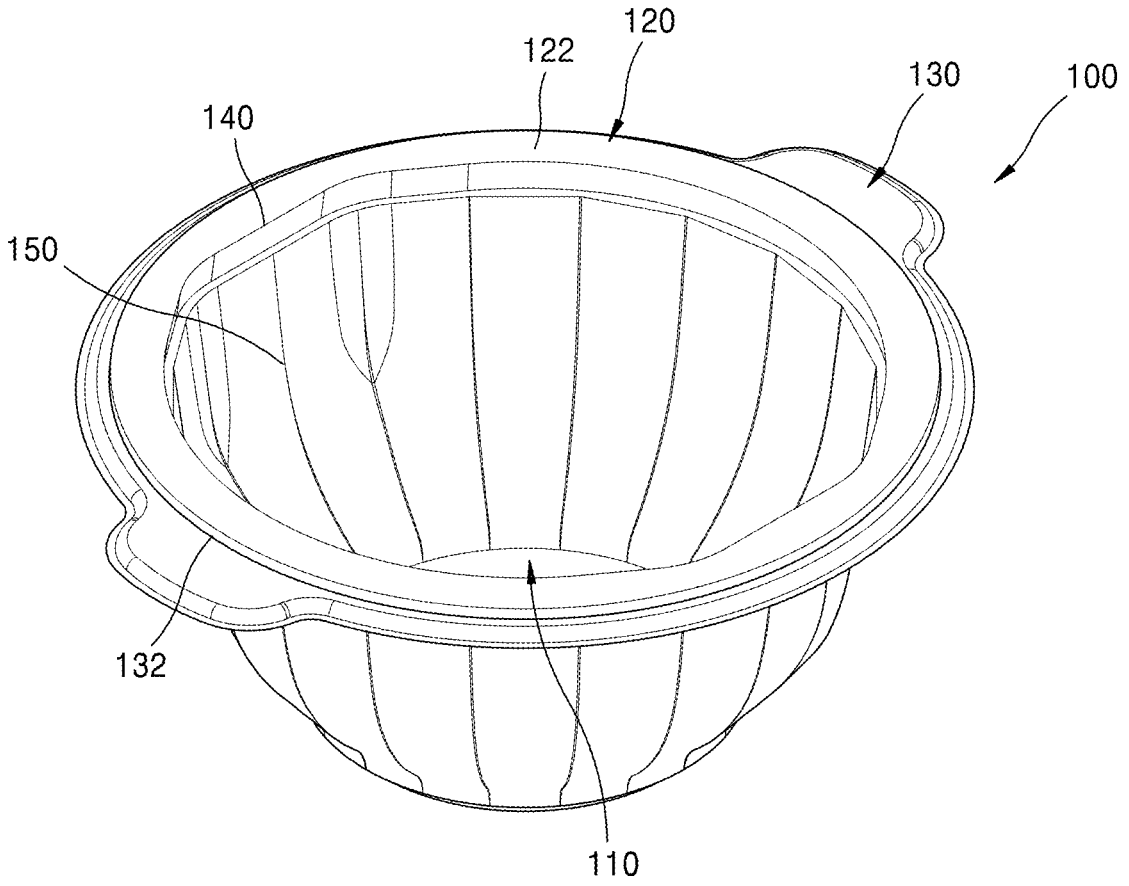
FIG. 1 is a view showing a container body of a container for retort food according to the present disclosure.
Figure 2:
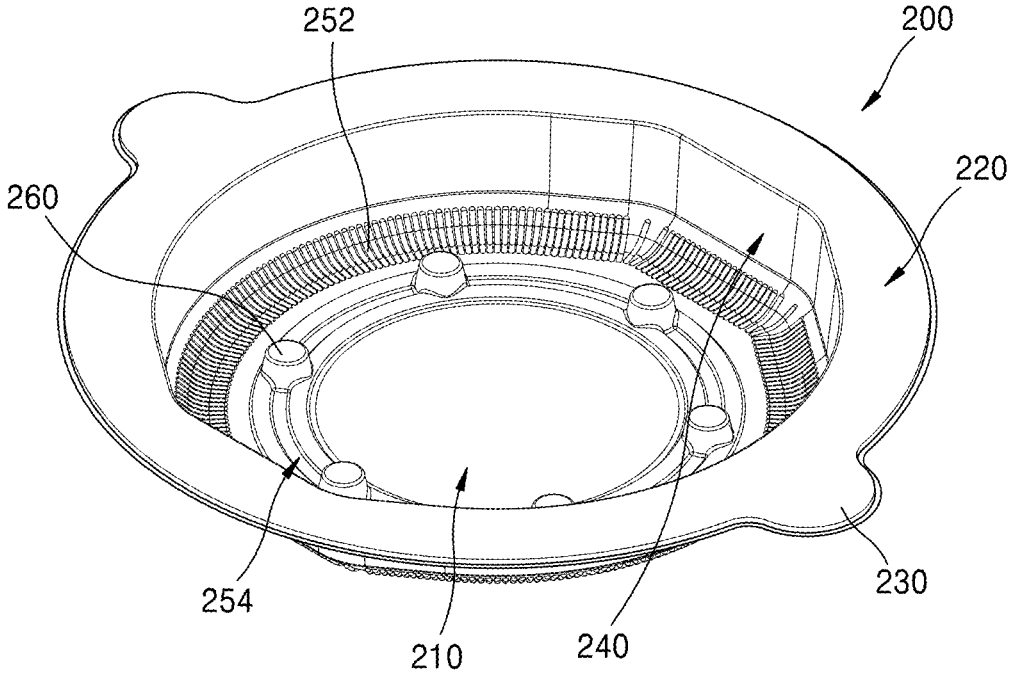
FIGS. 2 and 3 are views showing an inner cap of the container for retort food according to the present disclosure when viewed from the top and bottom.
Figure 3:
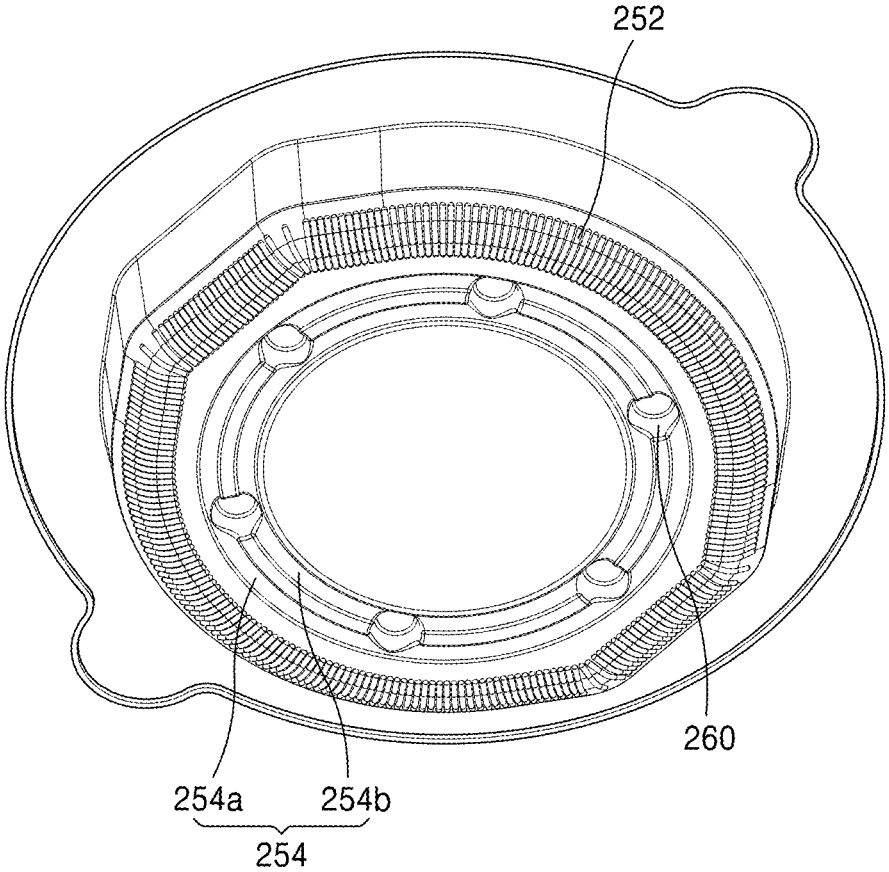
Figure 4:
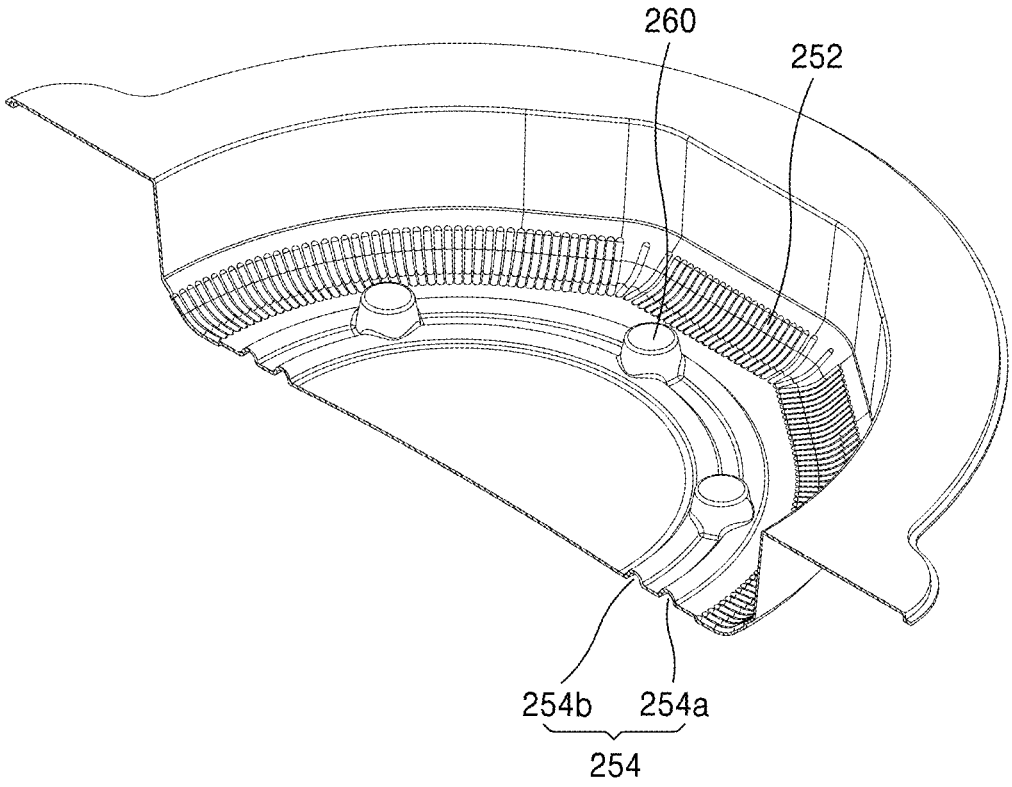
FIG. 4 is a cross-sectional view of the inner cap of the container for retort food according to the present disclosure.

FIG. 1 is a view showing a container body 100 of a container for retort food according to the present disclosure, FIGS. 2 and 3 are views showing an inner cap 200 of the container for retort food according to the present disclosure when viewed from the top and bottom, and FIG. 4 is a cross-sectional view of the inner cap 200 of the container for retort food according to the present disclosure.

The container for retort food according to the present disclosure may include: a container body 100 in which food may be input and stored; and an inner cap 200 covering the container body 100, and in addition, may further include a lid film.

The container body 100 includes a container bowl part 110 and a container flange part 120.

The container bowl part 110 may be a portion having a bowl shape. The container bowl part 110 has a space which is recessed with a predetermined area and a first depth in a downward direction and open in an upward direction. An inner space of the container bowl part 110 substantially constitutes a food input and storage space.

The container flange part 120 constitutes an outer peripheral region of an upper end of the container bowl part 110. The container flange part 120 may be configured in a ring shape that surrounds the outer circumference of the container bowl part 110. Thus, when the inner cap 200 is placed on the container body 100, a top surface 122 of the container flange part 120 may be in close contact with a bottom surface of a cap flange part 220 of the inner cap 200 which will be described later. Thus, the top surface 122 of the container flange part 120 may serve as a thermal fusion surface.

Container handles 130 may be provided on the outside of the container flange part 120. Each of the container handle 130 may be a portion that protrudes in an outer diameter direction of the container flange part 120. When lifting and moving the container body 100, a user may grip the container handles 130 with two hands.

The inner cap 200 may include a cap tray part 210 and a cap flange part 220.

The cap tray part 210 may be a portion having a tray shape. The cap tray part 210 has a space which is recessed with a predetermined area and a second depth in the downward direction and open in the upward direction. Preferably, the shape of the cap tray part 210 when viewed from the top may correspond to the shape of the container bowl part 110 when viewed from the top. Moreover, the inner space of the cap tray part 210 may constitute a storage space for various sauces, a spoon, and the like.

The cap flange part 220 constitutes an outer peripheral region of an upper end of the cap tray part 210. The cap flange part 220 may be configured in a ring shape that surrounds the outer circumference of the cap tray part 210. Thus, when the inner cap 200 is placed on the container body 100, the bottom surface of the cap flange part 220 may be placed on the top surface 122 of the container flange part 120.

Cap handles 230 may be provided on the outside of the cap flange part 220. Each of the cap handles 230 may be a portion that protrudes in an outer diameter direction of the cap flange part 220. Thus, when a user separates the inner cap 200 from the container body 100 or when the user lifts and moves the inner cap 200, the user may grip the cap handles 230.

Figure 5:
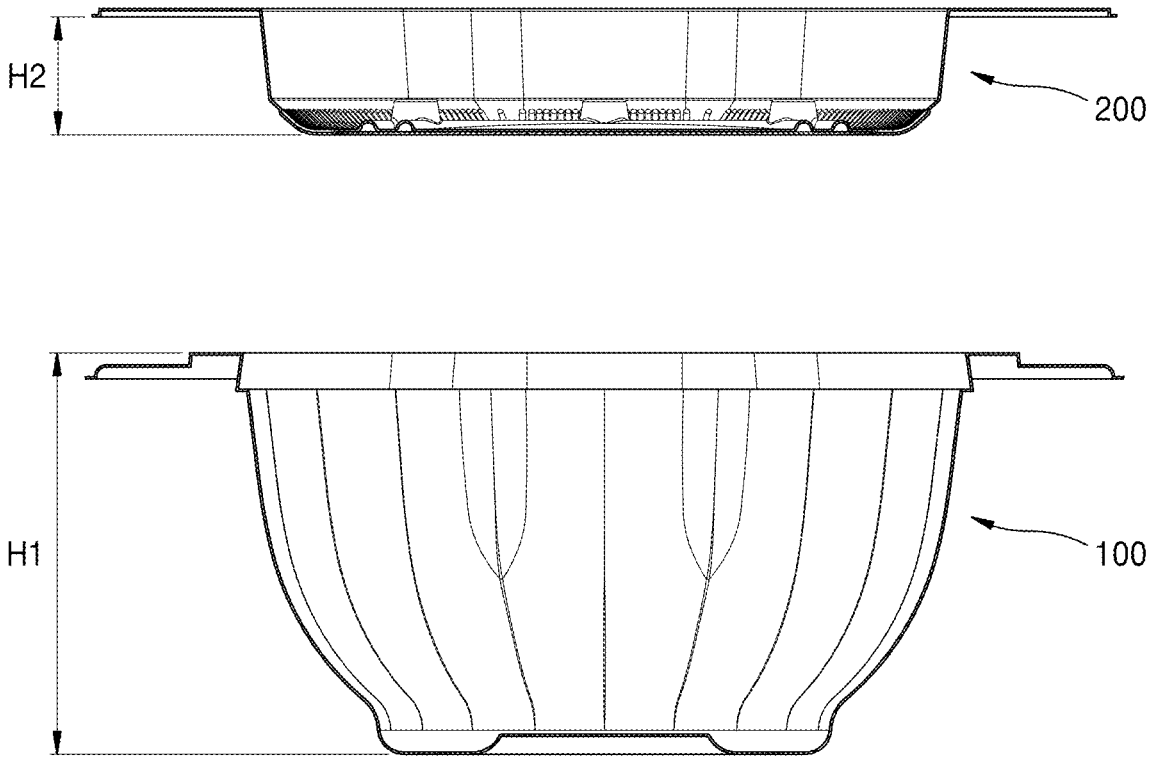
FIG. 5 is a view showing that the inner cap is placed on the container body of the container for retort food according to the present disclosure.

FIG. 5 is a view showing that the inner cap 200 is placed on the container body 100 of the container for retort food according to the present disclosure. Hereinafter, the effects of the container body 100 and the inner cap 200 as above will be described.

When the inner cap 200 is placed on the container body 100, the cap flange part 220 is placed on the container flange part 120. The cap tray part 210 is located inside an upper region of an inner space of the container bowl part 110 of the container body 100.

Accordingly, the cap tray part 210 may divide the inner space of the container bowl part 110 into upper and lower spaces. That is, the inner space of the container bowl part 110 is divided into the space below the cap tray part 210 and the space above the same. Moreover, when the container flange part 120 and the cap flange part 220 are thermally fused in a state in which the cap flange part 220 is placed on the container flange part 120, the cap tray part 210 may seal the space located below the cap tray part 210 in the inner space of the container bowl part 110.

Herein, the depth of the cap tray part 210 has a second depth H2, and the depth of the container bowl part 110 has a first depth H1. Thus, the space located below the cap tray part 210 has the depth corresponding to a value obtained by subtracting the second depth H2 from the first depth H1.

Thus, when food is input in the container body 100 and covered with the inner cap 200, the inner cap 200 (exactly, the bottom surface of the cap tray part 210 of the inner cap 200) may be located at a position adjacent onto the food.

In a retort food manufacturing process that uses the container for retort food according to the present disclosure, food is input in the container body 100, the inner cap 200 is placed on the container body 100, and then, the container flange part 120 and the cap flange part 220 may be thermally fused to each other. Subsequently, an sterilization operation may be performed by applying predetermined pressure and heat.

As described above, as the inner cap 200 having the cap tray part 210 is provided, the distance between a high-temperature atmosphere and the food within the container body 100 becomes reduced when the sterilization operation is performed in the retort food manufacturing process. That is, the distance between the food within the container body 100 and the high-temperature atmosphere when the container body 100 is covered with the inner cap 200 having the cap tray part 210 as in the above example becomes less than that when the container body 100 is covered with, for example, a cover having a flat plate shape (that is, when covered with an inner cap 200 having a flat plate shape without the cap tray part 210). Thus, effective sterilization for the food may be performed.

At the same time, the container body 100 has the sufficient depth, and thus, the space having the sufficient depth is secured above the food within the container body 100. Thus, when filled with food mainly composed of a liquid phase, the occurrence of an overflow accident may be prevented during moving. Also, even when an eater separates the inner cap 200 from the container body 100 so as to ingest the food, the overflow of food may be prevented, and the food may be safely eaten.

The limitations that may occur when using a general container and cap according to the related art unlike the present disclosure are as follow.

First, when the container has an increased depth to prevent the overflow of food and is covered with the cap having a flat plate shape, a large empty space is formed above the food within the container body. Thus, the distance between the cap and the food within the container body becomes increased. Thus, the sterilization may be unsatisfactory in the retort processing process. Here, higher temperature and higher pressure have to be applied to sufficiently ensure sterilization effects, but the high-temperature and high-pressure sterilization may cause deformation and damage to the container. Furthermore, it may be difficult to satisfy regulations regarding the packing space ratio established by the law.

For another example, when the depth of container is decreased while positioning the food and the cap such that the distance therebetween is reduced in order to perform effective sterilization in the retort processing process, it is difficult to sufficiently secure an empty space in the container body. Thus, when an eater removes the cap of the container, the overflow of food may easily occur. That is, it is impossible to achieve the effects of preventing the overflow of food as in the present disclosure.

However, the container for retort food according to the present disclosure is configured such that the depth of the container body 100 has the increased depth, and thus, the sufficient space that prevents the overflow of food may be secured. At the same time, as the inner cap 200 covering the container body 100 has the predetermined depth, the inner cap 200 is located at the position adjacent to the food within the container body 100, and thus, the distance between the retort process atmosphere and the food becomes reduced. Thus, the effective sterilization may be performed in the retort processing process.

Furthermore, as the container for retort food according to the present disclosure is provided with the inner cap 200 as described above, there may be an advantage of satisfying the regulations regarding the packing space ratio established by law. That is, when the container body 100 is covered with the inner cap 200 while preventing the overflow of food by increasing the depth of the container body 100, the inner space of the container body 100 becomes reduced by the cap tray part 210 provided in the inner cap 200, and thus, the regulations relating the packing space ratio is advantageously satisfied.

Hereinafter, each of detailed embodiments of the present disclosure and the effects thereby will be described.

Figure 6:
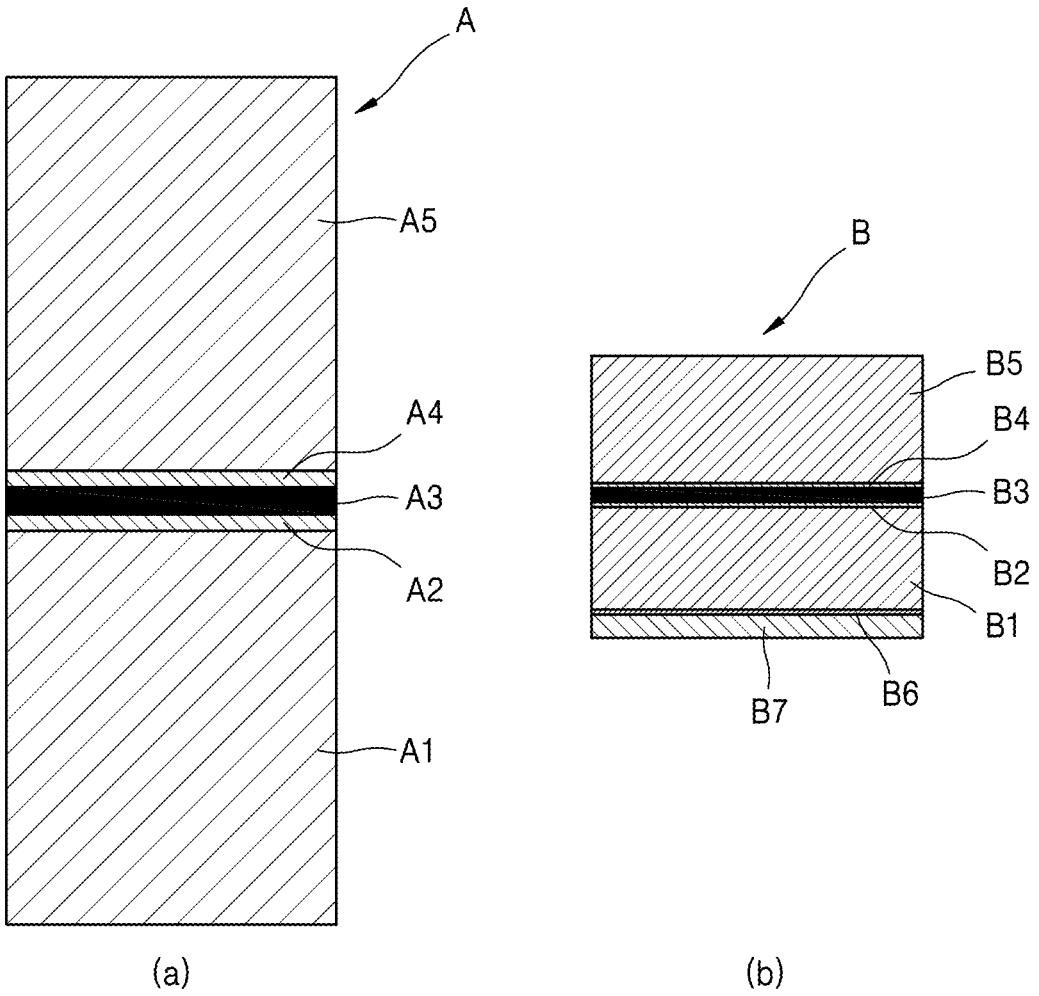
FIGS. 6(*a*) and 6(*b*) are enlarged views showing structures of sheets that constitute the container body and the inner cap, respectively.

FIGS. 6(*a*) and 6(*b*) are enlarged views showing structures of sheets that constitute the container body 100 and the inner cap 200, respectively.

According to a preferred embodiment, the container body 100 is made of a first sheet A having a predetermined thickness, and the inner cap 200 is made of a second sheet B having a predetermined thickness. For example, each of the container body 100 and the inner cap 200 may be manufactured by thermally forming the sheet that has the predetermined thickness.

Herein, the first sheet A may be two times to four times as thick as the second sheet B. Also, the first sheet A may have the thickness of 0.9 mm to 1.2 mm, and the second sheet B may have the thickness of 0.3 mm to 0.4 mm.

Thus, since the thickness of the inner cap 200 is less than the thickness of the container body 100, the thermal fusion to the container body 100 may be easily performed. Also, easy-peel effects may be obtained, which enable easy detachment from the container body 100 in a thermally fused state.

Also, according to a preferred embodiment, the first sheet A and the second sheet B, which respectively constitute the container body 100 and the inner cap 200, may have multi-layer structures. Also, the multi-layer structures may include an oxygen impermeable material. Thus, the container for retort food according to the present disclosure may be a container for room-temperature retort food, which allows food to be stored at room temperature.

Here, the container body 100 may include a first layer A1 and a fifth layer A5 which include a PP material, a second layer A2 and a fourth layer A4 which include an AD material, and a third layer A3 which includes EVOH. Herein, the first layer to the fifth layers may be stacked sequentially from the bottom to the top.

Also, like the container body 100, the inner cap 200 includes first to fifth layers B1, B2, B3, B4, and B5, which sequentially include PP, AD, EVOH, AD, and PP materials from the bottom to the top, and in addition, may include a sixth layer B6 which is below the first layer B1 and includes an AD and a seventh layer B7 which is below the sixth layer B6 and includes an easy peelable (EPL) material. Thus, the bottom surface of the cap flange part 220 may be easily thermally fused to the top surface 122 of the container flange part 120 and easily peeled off from the container flange part 120.

Also, according to a preferred embodiment, each of the container bowl part 110 and the cap tray part 210 may have an arrangement portion in at least a portion thereof. Accordingly, a first arrangement portion 140 may be provided in the container bowl part 110, and a second arrangement portion 240 may be provided in the inner cap 200. That is, the first arrangement portion 140 and the second arrangement portion 240 constitute the arrangement portion together.

The first arrangement portion 140 of the container bowl part 110 and the second arrangement portion 240 of the cap tray part 210 may have shapes corresponding to each other. Also, the arrangement portion may be a portion that has different curvature from the other regions. For example, when the container bowl part 110 and the cap tray part 210 have a generally circular shape, the first arrangement portion 140 and the second arrangement portion 240 may be configured in a straight-line section having a predetermined width.

As the arrangement portion is provided as described above, the directionality is given so that the cap handle 230 is located above the container handle 130 when the inner cap 200 is placed on the container body 100. Also, the inner cap 200 may be stably arranged on the container body 100.

Also, according to a preferred embodiment, the container handle 130 of the container body 100 and the top surface 122 of the container flange part 120 may have heights different from each other. That is, a stepped portion 132 is formed between the container handle 130 and the top surface 122 of the container flange part 120, and the container handle 130 may be located below the top surface 122 of the container flange part 120.

Thus, when the container flange part 120 of the container body 100 and the cap flange part 220 of the inner cap 200 are thermally fused to each other after the inner cap 200 is placed on the container body 100, the container handle 130 of the container body 100 and the cap handle 230 of the inner cap 200 are vertically spaced apart from each other without interference. That is, a gap is formed between the cap handle 230 and the container handle 130, and thus, a user may hold the cap handle 230 of the inner cap 200 and easily detach the inner cap 200.

According to a preferred embodiment, the container bowl part 110 may have a polygonal structure 150. For example, the container bowl part 110 may have the polygonal structure 150 with twenty angles.

The polygonal structure 150 provided in the container bowl part 110 as described above may give effects of reinforcing strength of the container bowl part 110. Thus, even if pressure is generated inside or outside the container bowl part 110 in the retort processing process, it is possible to prevent the container bowl part 110 from being deformed or broken.

According to a preferred embodiment, the cap tray part 210 may have a three-dimensional rib structure. The three-dimensional rib structure may have an arbitrary structure, and any structure may be applied as long as the structure can reinforce the strength of the cap tray part 210.

According to one example, the three-dimensional rib structure may be a first rib 252 which is made of protrusions and recesses repeatedly formed along a circumferential region on the bottom surface of the cap tray part 210. Also, there may be provided a second rib 254 having a ring form, which is formed on the bottom surface of the cap tray part 210 and has a ring shape having a predetermined inner diameter, and a cross-section thereof has a half circular shape or a parabola having predetermined curvature. Here, the second rib 254 may include a second-first rib 254*a* having a large radius and a second-second rib 254*b* having a small radius.

As the three-dimensional rib structure is provided as described above, the inner cap 200 may be allowed to have sufficient strength even if manufactured with a sheet having a relatively small thickness. Thus, it is possible to prevent the phenomenon in which the inner cap 200 is crushed while the retort process is performed and the phenomenon in which the bottom surface of the inner cap 200 is deflected or crushed due to generation of negative pressure or the like after the retort process, and various damages and breakage may be prevented from occurring during storage and carrying.

According to a preferred embodiment, the cap tray part 210 may have a stacking protrusion portion 260 that protrudes in the upward and downward direction. For example, the stacking protrusion portion 260 may have a three-dimensional structure which has the bottom surface recessed in the upward direction and the top surface correspondingly protruding in the upward direction. The number of stacking protrusion portions 260 may be arbitrary. For example, three to six may be provided, and preferably, six may be provided. Moreover, placement positions thereof may be arbitrary.

As the stacking protrusion portions 260 are provided as described above, stacking gaps between inner caps 200 are ensured during stacking, carrying, and using after manufactured, and thus stacking and separation may be conveniently performed.

Moreover, the stacking protrusion portions 260 may be located overlapping three-dimensional rib structure. For example, as described above, the second rib 254 having a ring shape and the stacking protrusion portion 260 may be formed overlapping each other.

Figure 7:
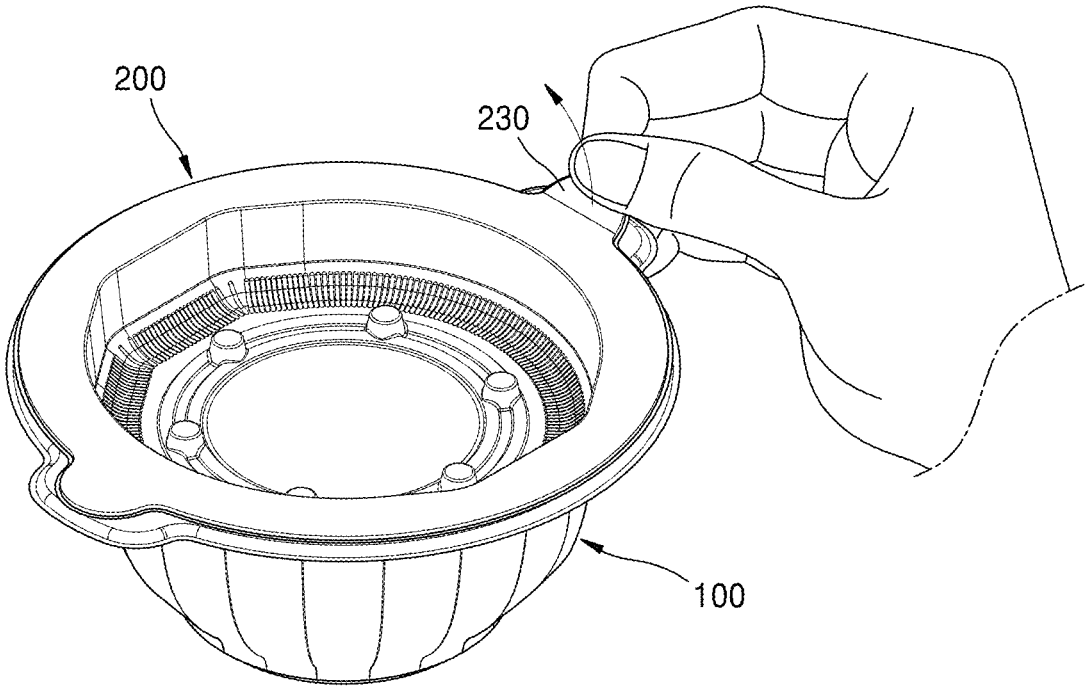
FIG. 7 is a view showing that the inner cap of the container for retort food according to the present disclosure is disengaged from the container body.
Figure 8:
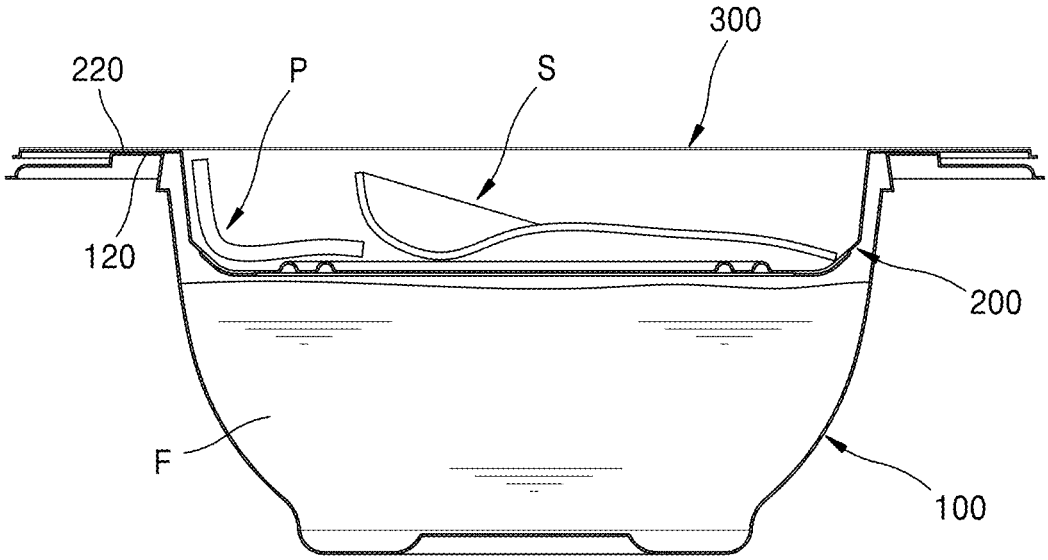
FIG. 8 is a view showing that a lid film is sealed in a state in which a spoon and a pouch are put on the inner cap in the container for retort food according to the present disclosure.
Figure 9:
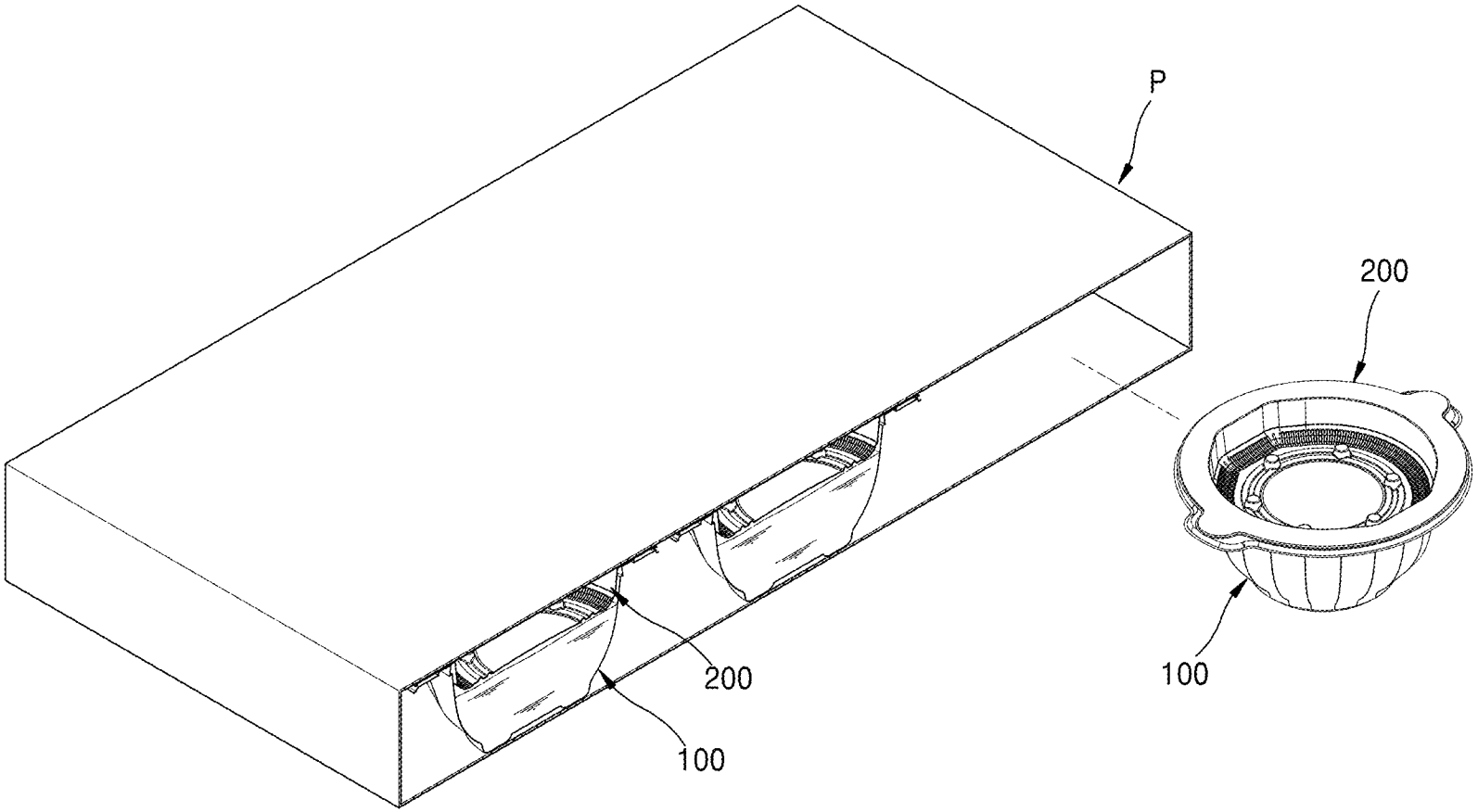
FIG. 9 is a view showing one distribution form of a container for retort food according to the present disclosure.

FIGS. 7 to 9 show an usage form of the container for retort food according to the present disclosure. FIG. 7 is a view showing that the inner cap 200 of the container for retort food according to the present disclosure is disengaged from the container body 100, and FIG. 8 is a view showing that a lid film 300 is sealed in a state in which a spoon S and a pouch P are put on the inner cap 200 in the container for retort food according to the present disclosure. FIG. 9 is a view showing one distribution form of a container for retort food according to the present disclosure.

As illustrated in FIG. 7, when the container for retort food according to the present disclosure is used, the container body 100 may be opened by removing the inner cap 200 from the container body 100 while holding the inner cap 200. As described above, the inner cap 200 is easily peelable from the container body 100, and thus, user convenience may be improved. Here, preferably, since there may be a gap between the top of the container handle 130 of the container body 100 and the bottom surface of the cap handle 230 of the inner cap 200, a user may more easily remove the inner cap 200.

Moreover, a preferred embodiment as illustrated in FIG. 8 may further include a lid film 300 which is located above the inner cap 200 to cover an inner space of the cap tray part 210 and is in close contact with the top of the cap flange part 220. The inner space of the cap tray part 210 may be sealed by the lid film 300, and the pouch P containing accompanying soup base, the spoon S, and the like may be stored within the space of the cap tray part 210. Thus, the user convenience may be improved, and packing costs may be reduced because a separate packing means is not necessary.

The lid film 300 as described above may not be essential but selectively provided. For example, as illustrated in FIG. 9, a container for retort food according to the present disclosure may be distributed or used in a state in which only the container body 100 and the inner cap 200 are coupled without the lid film 300. In particular, as illustrated in FIG. 9, there may be provided a predetermined paper box P in which a bundle of containers for retort food according to the present disclosure are packed.

Although the preferred examples have been illustrated and described, the present disclosure is not limited to the specific examples described above, and it is obvious that various modifications may be made by those skilled in the art to which the present disclosure pertains without departing from the subject matter of the present disclosure as set forth in the claims, and it is to be noted that those modifications should not be understood separately from the technical concept and prospect of the present disclosure.

The invention claimed is:

1. A container for retort food, the container comprising:

a container body; and an inner cap, wherein the container body comprises a container bowl part having a space which is recessed with a first depth in a downward direction and open in an upward direction and a container flange part constituting a periphery of an upper end of the container bowl part, wherein the inner cap comprises a cap tray part having a space which is recessed with a second depth in the downward direction and open in the upward direction and a cap flange part constituting a periphery of an upper end of the cap tray part, wherein, when the inner cap is placed on the container body, the cap tray part is located inside an upper region of an inner space of the container bowl part of the container body, and the cap tray part divides the inner space of the container bowl part into upper and lower spaces, wherein, when thermal fusion is performed in a state in which the cap flange part is placed on the container flange part, the lower space inside the container bowl part is sealed, wherein the cap tray part has a plurality of stacking protrusion portions, and having a rib which is formed on the bottom surface of the cap tray part and has a ring shape having a predetermined inner diameter and of which a cross-section has a shape having predetermined curvature, and wherein the stacking protrusion portions are formed at positions overlapping the rib.

2. The container for retort food of claim 1, wherein the container body is made of a first sheet having a predetermined thickness, and the inner cap is made of a second sheet having a predetermined thickness, and the first sheet is two times to four times as thick as the second sheet.

3. The container for retort food of claim 2, wherein the first sheet has a thickness of 0.9 mm to 1.2 mm, and the second sheet has a thickness of 0.3 mm to 0.4 mm.

4. The container for retort food of claim 1, wherein each of the container body and the inner cap has a multi-layer structure comprising an oxygen impermeable material.

5. The container for retort food of claim 1, wherein the inner cap comprises an easy peelable (EPL) material so as to be easily peelable from the container flange part in a state in which a bottom surface of the cap flange part is thermally fused to a top surface of the container flange part.

6. The container for retort food of claim 1, wherein each of the container bowl part and the cap tray part has, in at least a portion thereof, an arrangement portion having a predetermined width in a circumferential direction and having curvature different from that of the other regions.

7. The container for retort food of claim 1, wherein the container body has a container handle that protrudes from the container flange part in an outer diameter direction, and the inner cap has a cap handle that protrudes from the cap flange part in an outer diameter direction, wherein a stepped portion is formed between the container handle and the container flange part, and a top surface of the container handle is located below a top surface of the container flange part.

8. The container for retort food of claim 1, wherein the container bowl part has a polygonal structure.

9. The container for retort food of claim 1, wherein the cap tray part has a three-dimensional rib structure on a bottom surface thereof.

10. The container for retort food of claim 9, wherein the three-dimensional rib structure comprises:

a first rib which is made of protrusions and recesses repeatedly formed along a circumferential region on the bottom surface of the cap tray part; and a second rib which is formed on the bottom surface of the cap tray part and has a ring shape having a predetermined inner diameter and of which a cross-section has a shape having predetermined curvature.

11. The container for retort food of claim 1, wherein three to six stacking protrusion portions are provided, and formed on the bottom surface of the cap tray part and has a three-dimensional structure that protrudes in the upward direction.

12. The container for retort food of claim 1, further comprising a lid film which is located above the inner cap to cover an inner space of the cap tray part and is in close contact with a top surface of the cap flange part.

* * * * *